US012807287B2

(12) United States Patent
Cufone

(10) Patent No.: US 12,807,287 B2
(45) Date of Patent: Nov. 24, 2026

(54) ROPE RECOVERY TOOL

(71) Applicant: Mario John Cufone, Greenwith (AU)

(72) Inventor: Mario John Cufone, Greenwith (AU)

( * ) Notice: Subject to any disclaimer, the term of this patent is extended or adjusted under 35 U.S.C. 154(b) by 298 days.

(21) Appl. No.: 18/633,638

(22) Filed: Apr. 12, 2024

(65) Prior Publication Data

US 2024/0253754 A1 Aug. 1, 2024

Related U.S. Application Data

(63) Continuation-in-part of application No. 17/444,921, filed on Aug. 12, 2021, now abandoned.

(30) Foreign Application Priority Data

Aug. 26, 2020 (AU) ..... 2020223701

(51) Int. Cl.
*B63C 7/16* (2006.01)
*B63C 7/00* (2006.01)

(52) U.S. Cl.
CPC . *B63C 7/16* (2013.01); *B63C 7/00* (2013.01)

(58) Field of Classification Search
CPC .. B63C 7/00; B63C 7/16; B63C 11/00; B63C 11/52
USPC ..... 114/44
See application file for complete search history.

(56) References Cited

U.S. PATENT DOCUMENTS

| | | | |
|---|---|---|---|
| 504,203 | A | 8/1893 | De Bem |
| 3,000,535 | A | 9/1961 | Erdmann |
| 6,038,807 | A | 3/2000 | Taylor |

FOREIGN PATENT DOCUMENTS

| | | | |
|---|---|---|---|
| AU | 2020200830 | A1 | 9/2020 |
| KR | 20050012105 | A | 1/2005 |
| WO | 2011067694 | A1 | 6/2011 |

OTHER PUBLICATIONS

AU Examination Report—AU2020223701, Aug. 18, 2022.
AU Notice of Grant—AU2020223701, Aug. 31, 2023.

*Primary Examiner* — Lars A Olson
(74) *Attorney, Agent, or Firm* — Sand, Sebolt & Wernow Co., LPA

(57) ABSTRACT

A rope recovery tool for use on an anchor rope. The rope recovery tool includes a weight and a saddle that enclose the anchor rope. A blade is nested between the saddle and the weight. A recovery rope is attached to the rope recovery tool. In use, the tool is fed down the anchor rope until the tool reaches the anchor rope's end. The recovery rope is used to pull on the rope recovery tool, causing the blade on the rope recovery tool to cut the anchor rope to make the anchor rope recoverable whilst sacrificing the anchor.

13 Claims, 8 Drawing Sheets

ROPE RECOVERY TOOL

REFERENCE TO RELATED APPLICATIONS

This application is a Continuation-in-part of U.S. patent application Ser. No. 17/444,921, filed Aug. 12, 2021, which application claims priority from Australian Patent Application Serial Number AU 2020223701, filed Aug. 26, 2020, the entire specifications of which are incorporated herein by reference.

TECHNICAL FIELD

The present invention relates to a rope recovery tool where the rope is attached to an anchor and the anchor cannot be retrieved.

BACKGROUND ART

Recreational fishing is a very popular pastime. Typical fishing boats are anywhere between 5 to 10 meters in length and once a desired fishing spot is found, the boat operator will engage an anchor to keep the boat in the same position because failing to do so would cause the boat to tend to drift. The anchor is first connected to a chain that keeps the anchor flat on the sea floor and the chain is then connected to a rope that extends from the boat. The depth that may be fished may be tens or hundreds of meters deep and because typically the rope extends to the boat at an angle, the rope in the water maybe a few hundred meters long.

When it is time to move to a new fishing spot or return to port, the anchor is winched up. However, there are times when the anchor tends to snag on rocks, outcroppings, coral, or the sea floor. Larger fishing boats that have sufficient engine capacity are generally able to simply forcefully drag the anchor out of the water, but smaller vessels may not have the power to do so. At times, the only option for the boat operator is to cut the anchor rope. A buoy may be attached to the rope prior to cutting for subsequent possible retrieval by a diver. But, if the rope is too deep in the water, the cost to retrieve the rope and anchor may become prohibitive and the rope may be abandoned.

Having a length of rope freely moving around the sea floor or even floating in the water is an obvious hazard and is obviously undesirable.

SUMMARY OF THE INVENTION

The object of the present disclosure is to provide a tool that enables recovery of an anchor rope even if the anchor on the rope is shagged and not retrievable under typical circumstances.

In a first aspect the invention comprises a method of recovering an anchor rope comprising providing a rope recovery tool including a body having a weight and a saddle which define a cavity between them, wherein the cavity extends longitudinally from a first end of the body to a second end thereof; wherein a blade is nested within the cavity and is pivotally engaged with the saddle, wherein a cutting surface is provided on the blade. The method further comprises attaching a recovery rope to the rope recovery tool; receiving the anchor rope through the cavity of the body; feeding the rope recovery tool downwardly from a surface of a body of water and along the anchor rope until the rope recovery tool reaches an end of the anchor rope; wherein, when an anchor on the anchor rope becomes snagged, the method includes pulling the recovery rope upwardly and moving the rope recovery tool in a direction away from the anchor and towards the surface of the body of water; contacting the cutting surface of the blade with the anchor rope; wherein through application of a pulling force applied by a human operator and through friction the anchor rope is cut free from the anchor by the blade of the rope recovery tool.

When the recovery rope is selectively pulled upwardly to move the rope recovery tool back towards the surface of the body of water, the anchor rope travels along a V-shape of the cutting surface of the blade from a wider region of the cutting surface to a narrower region thereof, and the anchor rope is thereby severed by the cutting surface. When the rope recovery tool moves down the anchor rope and away from the surface of the body of water, the cutting surface of the blade faces away from the anchor rope and the cutting surface is unable to cut the anchor rope. When the rope recovery tool is pulled upwardly towards the surface of the body of water, the cutting surface of the blade intersects the anchor rope and cuts the anchor rope.

In a second aspect of the invention, a rope recovery tool is disclosed for use on an anchor rope engaged with an anchor, said rope recovery tool comprising a body including a weight and a saddle which define a cavity between them, wherein the cavity extends longitudinally from a first end of the body to a second end thereof, and wherein the cavity is adapted to receive the anchor rope therethrough; a blade nested within the cavity, wherein the blade is pivotally engaged with the saddle; a cutting surface provided on the blade; a recovery rope attached to the rope recovery tool, wherein the recovery rope is adapted to be engaged with the anchor rope; and wherein the rope recovery tool is adapted to be located proximate an end of the anchor rope.

In preference the blade has a scissor mouth, which intersects the anchor rope and then the blade cuts into the anchor rope.

In preference the blade has screw holes, through which a bolt can be screwed into in order to fix the blade on the straddle of the recovery tool.

In preference the bolt screws in sequence through a screw hole on the straddle, the screw holes of the blade, another screw hole on the straddle and then into a nut to ensure that the blade remains in place.

In preference the saddle is permanently attached to the weight by hinges on one side in the axial direction and is lockably connected to the weight on the other side in the axial direction.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will refer to several drawings as follows.

DETAILED DESCRIPTION

Figure 1:
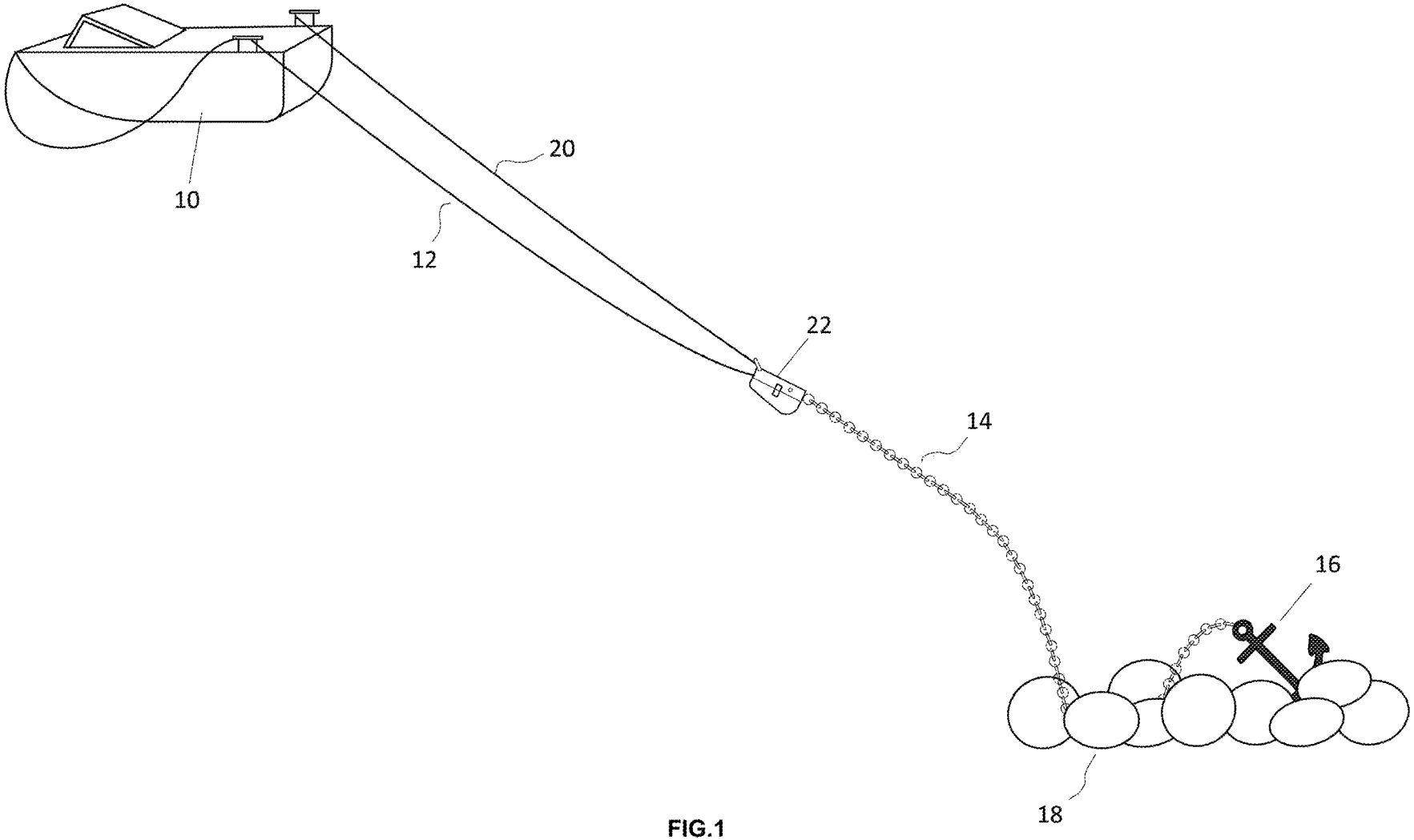
FIG. 1 is a schematic view of the use of the rope recovery tool according to an embodiment of the present invention.
Figure 2:
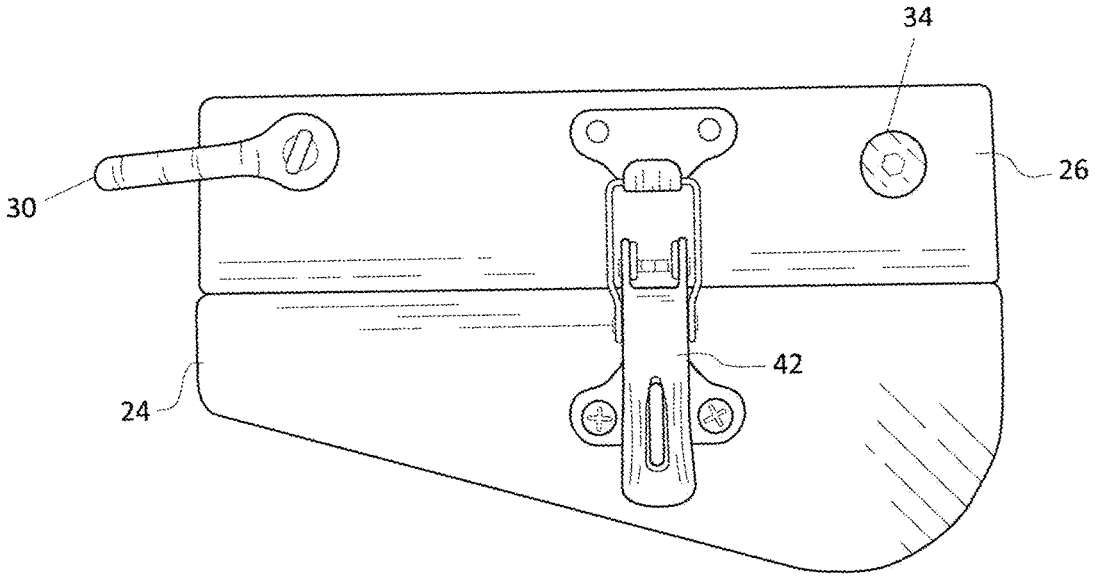
FIG. 2 is a front view of the rope recovery tool according to an embodiment of the present invention.
Figure 3:
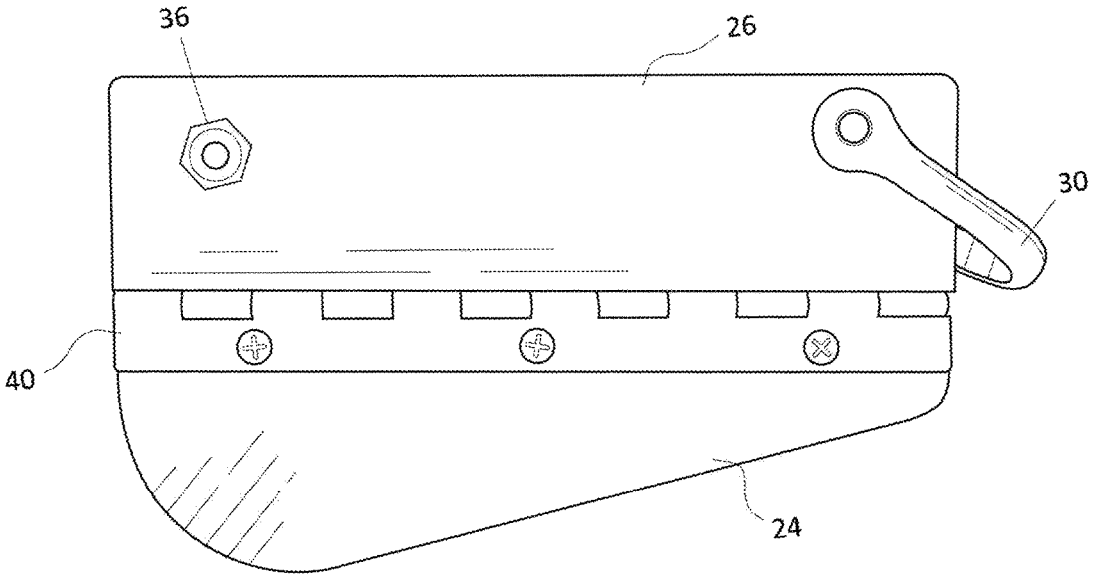
FIG. 3 is a back view of the rope recovery tool according to an embodiment of the present invention.

The following detailed description of the invention refers to the accompanying drawings. Wherever possible, the same reference numbers will be used throughout the drawings and the following description to refer to the same and like part s. Dimensions of certain parts shown in the drawings may have been modified and/or exaggerated for the purposes of clarity or illustration.

Referring now to the Figures in detail, as shown in FIG. 1, a boat 10 uses an anchor rope 12 attached to an anchor chain 14 that is connected to an anchor 16. When the anchor 16 becomes snagged and cannot be retrieved from the sea floor 18 by moving the boat 10 the recovery tool 22 is used.

As shown in FIGS. 2-6, a weight 24 and a saddle 26 are connected using a hinge 40 and a hasp lock 42 to form a cavity that enclose the anchor rope 12 which needs retrieving. The cavity could be opened or closed by unlocking or locking the hasp lock 42. In a preferable embodiment the saddle is permanently attached to the weight by a hinge 40 on one side in the axial direction and is lockably connected to the weight 24 on the other side in the axial direction. When the anchor rope 12 is placed by the operator into the cavity and afterwards the hasp lock 42 is locked, then the anchor rope 12 will be captured in the cavity between the straddle 26 and the weight 24. Consequently, the anchor rope 12 can only move forward or backward along its axial direction in the cavity.

The recovery tool 22 is then fed down the anchor rope 12 using a recovery rope 20 that is attached to the recovery tool 22 using a shackle 30 or other types of connecting link devices. The weight 24 ensures that the recovery tool 22 slides downward on the anchor rope 12. The size of the cross section of the cavity formed by the weight 24 and the saddle 26 is bigger than that of the anchor rope 12 but smaller than that of the anchor chain 14. When the recovery tool 22 reaches the end of the anchor rope 12 where the anchor chain 14 starts, it will stop there. Then, the operator can pull the recovery tool 22 by pulling the recovery rope 20 to cut the anchor rope 12 such that it can be retrieved by the operator. In some embodiments of the present invention, the recovery tool 22 can be manufactured in different sizes according to the varying size of the anchor rope 12 without any substantial structural changes to the recovery tool 22 as long as its diameter is small than that of the anchor chain 14.

Figure 4:
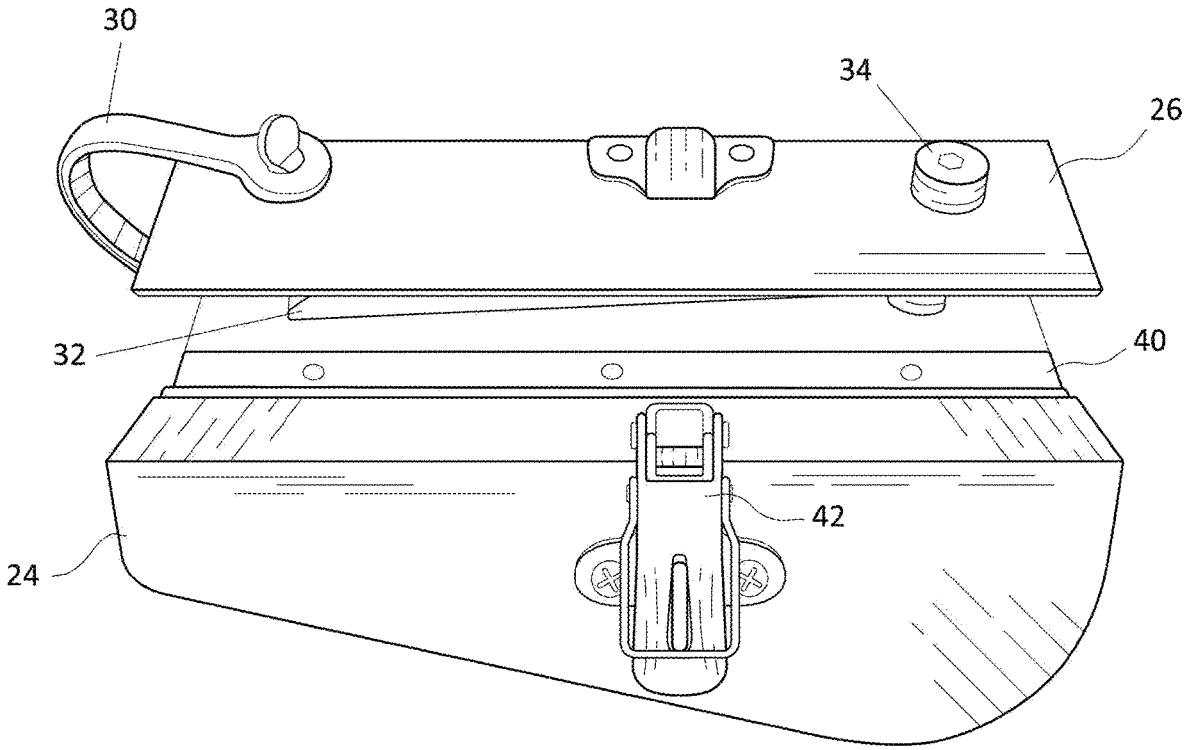
FIG. 4 is a front view of the rope recovery tool in an unlocked state according to an embodiment of the present invention.
Figure 5:
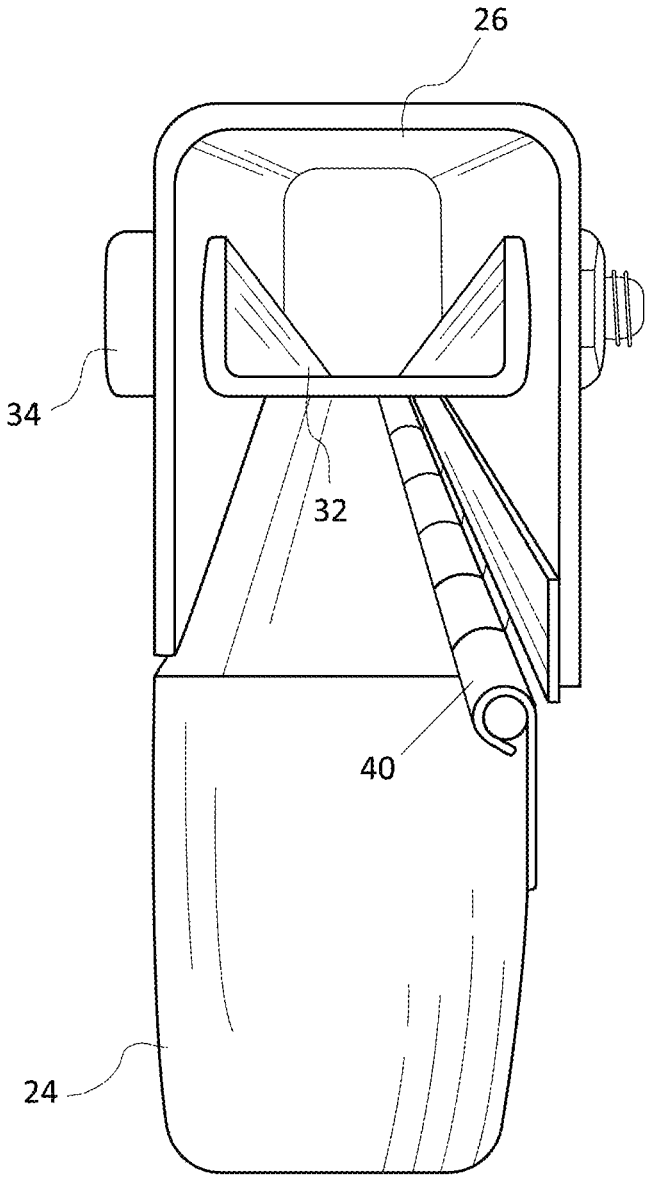
FIG. 5 is a right view of the rope recovery tool according to an embodiment of the present invention.
Figure 6:
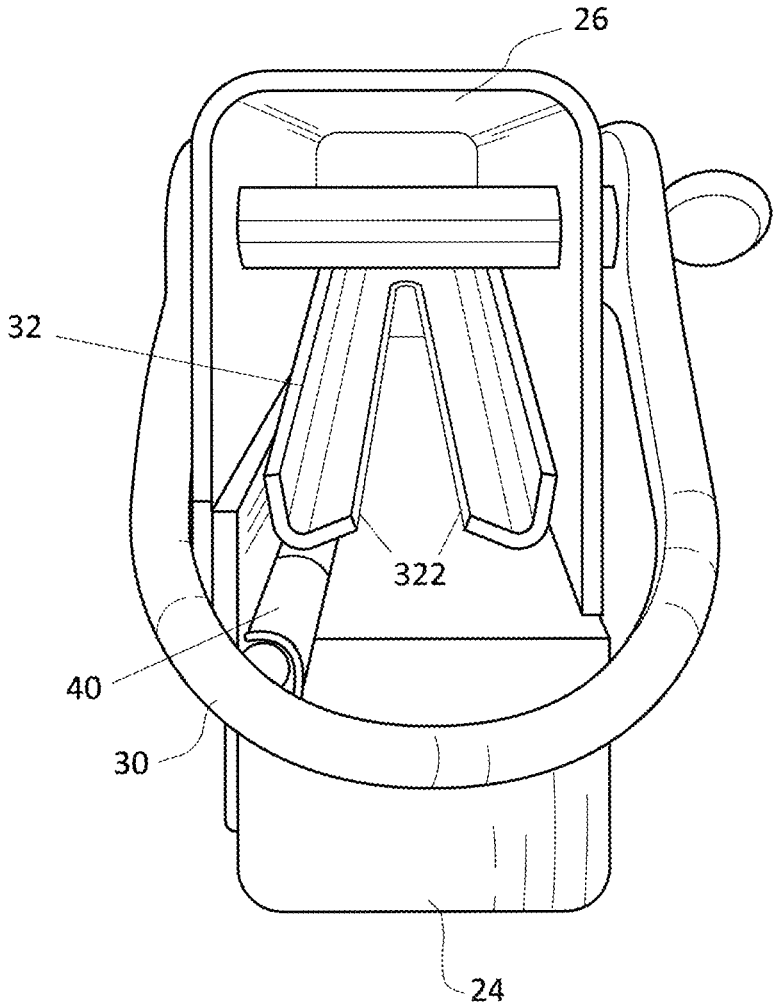
FIG. 6 is a left view of the rope recovery tool according to an embodiment of the present invention.
Figure 7A:
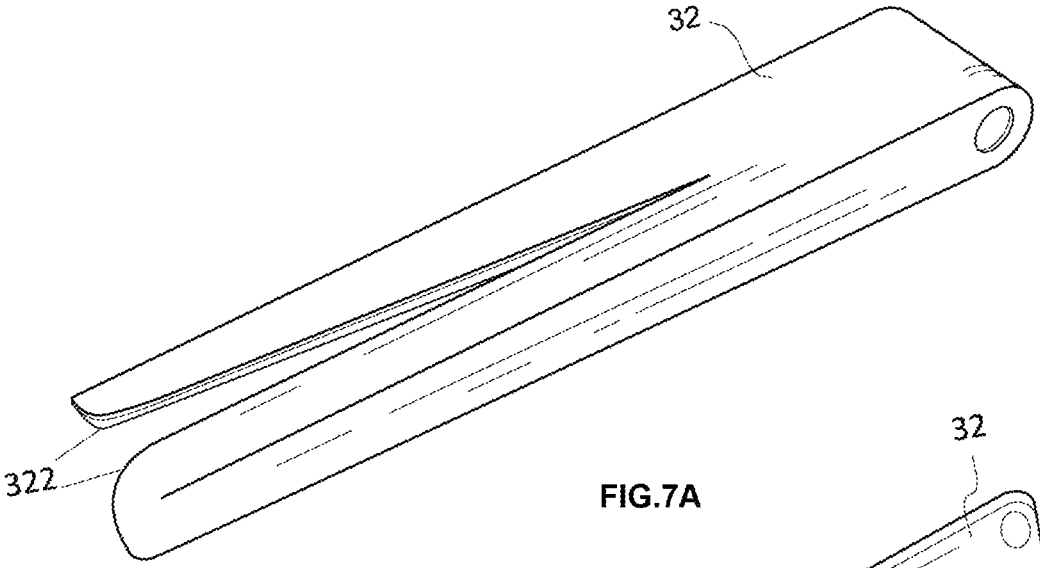
FIG. 7*a* is a three-dimensional top view of one side of the blade according to an embodiment of the present invention.
Figure 7B:
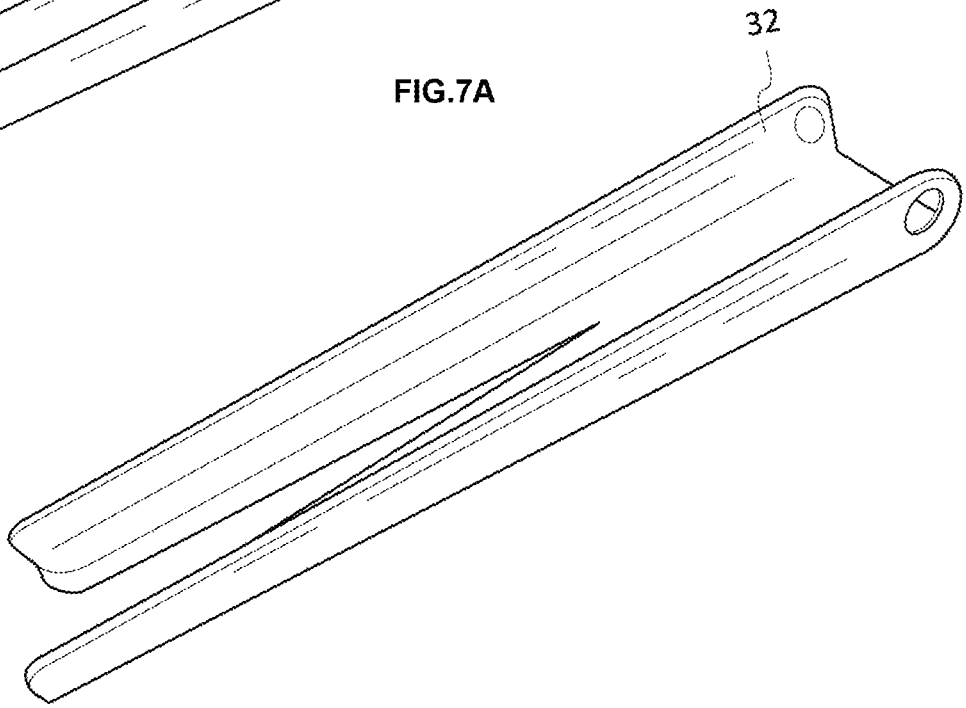
FIG. 7*b* is a three-dimensional top view of the other side of the blade according to an embodiment of the present invention.

Referring to FIGS. 4-6, in some embodiments, located within the recovery tool 22 is a blade 32 which preferably has a scissor mouth 322 as its cutting surface at one end and screw holes at the other far end of it, through which a bolt 34 can be screwed into in order to fix the blade 32 on the straddle 26 of the recovery tool 22. More specifically, the bolt 34 screws in sequence through one screw hole on the straddle 26, screw holes of the blade 32, the other screw hole on the straddle 26 and finally into a nut 36 to ensure that the blade 32 remains in place as shown in FIG. 4 and FIG. 8*b*. As a result, the blade 32 can rotate under the effect of gravity around the bolt 34 as its rotating pivot in a small range of degrees when there is nothing in the cavity because its movements are limited in the cavity between the straddle 26 the weight 24. The configuration of the blade 32 is shown in FIGS. 7*a* and 7*b* in detail.

Figure 8A:
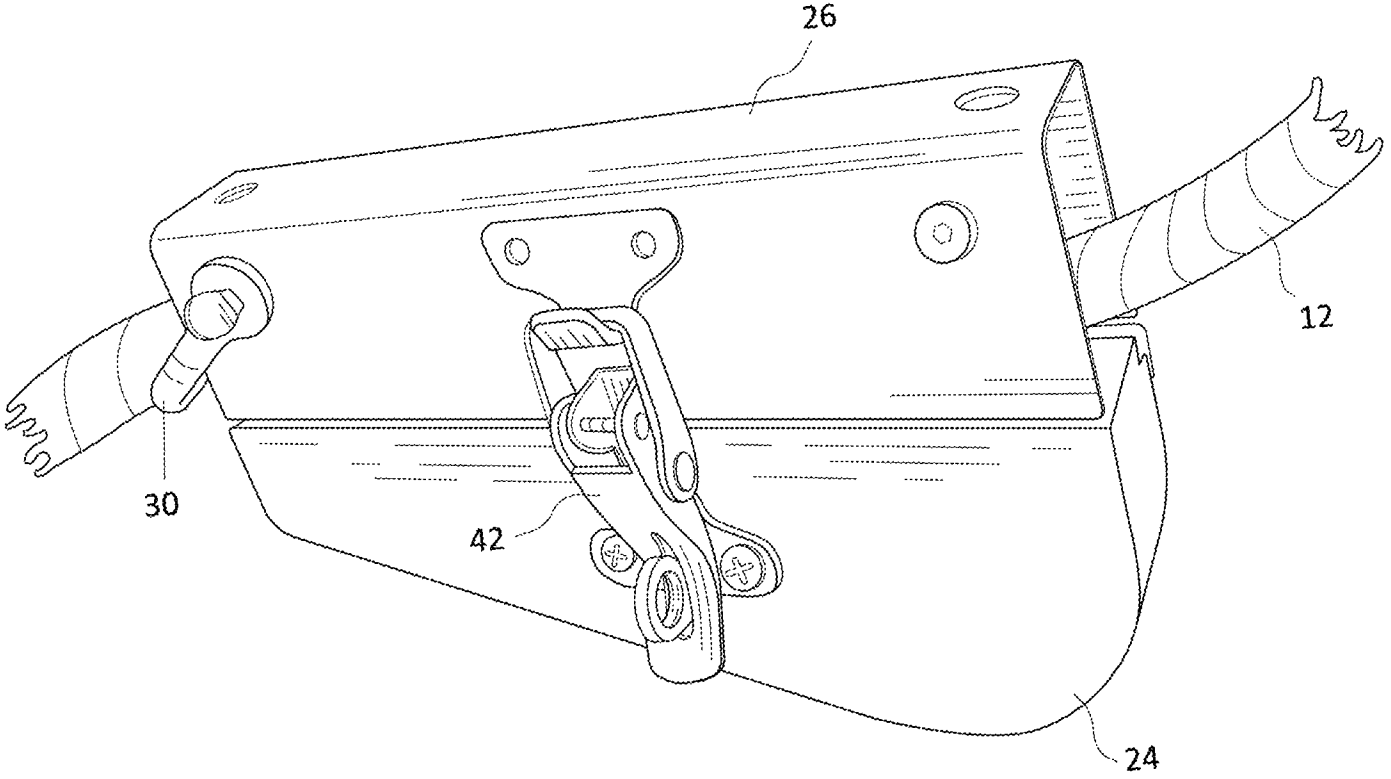
FIG. 8*a* is a three-dimensional top view of the rope recovery tool with part of the anchor rope according to an embodiment of the present invention.
Figure 8B:
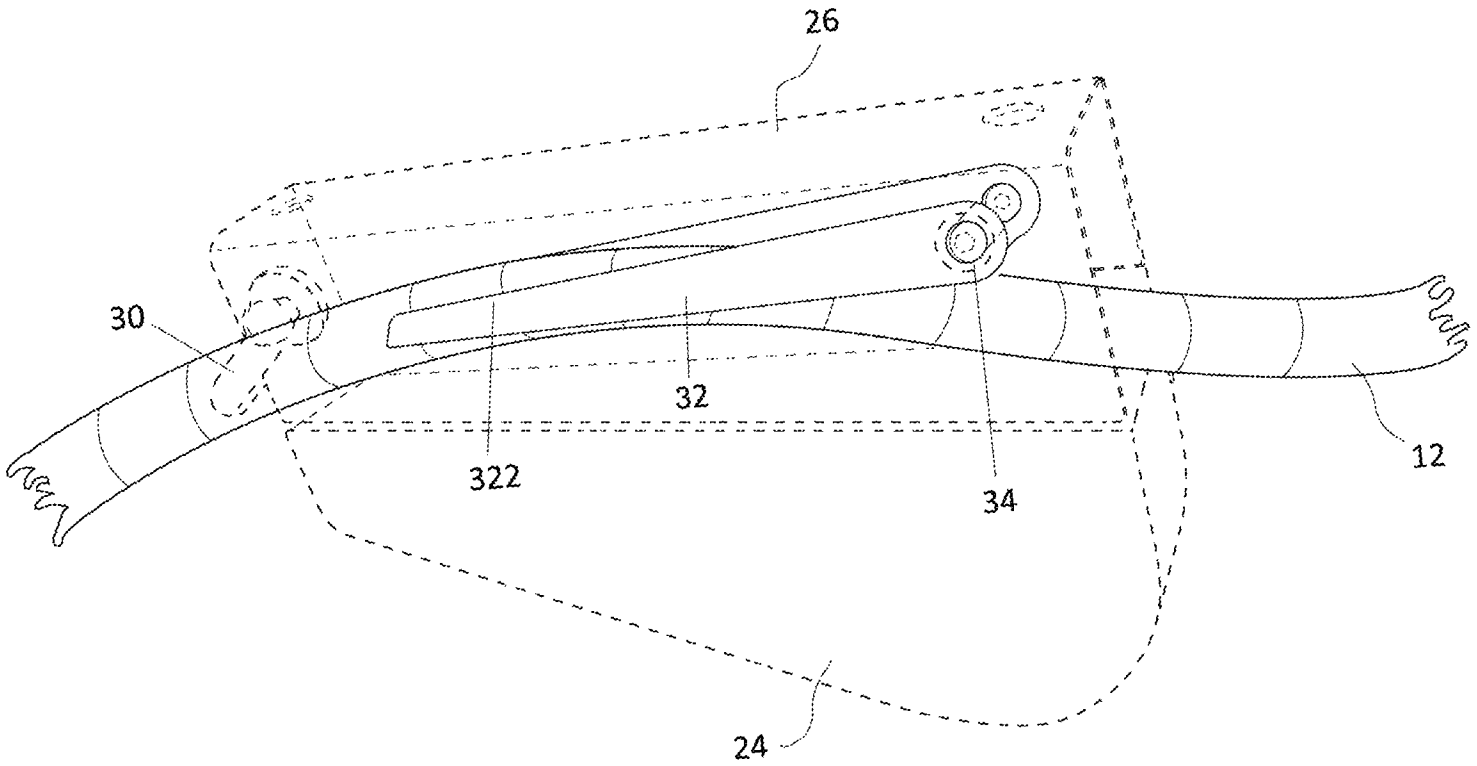
FIG. 8*b* is a three-dimensional perspective top view of the rope recovery tool with part of the anchor rope according to an embodiment of the present invention.

FIGS. 8*a* and 8*b* show how the rope recovery tool 22 works with part of the anchor rope 12 according to an embodiment of the present invention. When the recovery tool 22 slides down along the anchor rope 12, the cutting surface of the blade 32 which is preferably the scissor mouth 322 is facing away from the anchor rope 12, which therefore is unable to cut the anchor rope 12. Whereas as the recovery tool 22 is being pulled up, the scissor mouth 322 intersects with the anchor rope 12 and then the blade 322 cuts into the anchor rope 12 and eventually cuts through it under the pulling force of the operator and the force of friction, separating the anchor rope 12 from the anchor chain 14 and the anchor 16 and allowing the anchor rope 12 to be retrieved. The recovery tool 22 is then also retrieved using the recovery rope 20.

The dimensions of the recovery tool 22 may be selected based upon a range of anchor rope thicknesses but for typical small boats is of the order of some 20 cm long and 10 cm tall. The cross section of the recovery tool 22 can be like a rectangle shape as shown in FIGS. 5-6 or other shapes, such as a square or an ellipse, which does not affect the protection scope of the present invention. The weight 24 may be cut or a cast block.

The recovery tool 22 provided by the present invention is designed skillfully to place the blade 22 between the weight 24 and the saddle 26, make use of the gravity, the pulling force of the operator and the friction force between the blade 22 and the anchor rope 12 that occurs during the course of pulling the anchor rope 12 against the blade 22 in the cavity, to cut the anchor rope 12 through and retrieve the anchor rope 12 that left in the sea water. It provides a practical approach to retrieve the anchor rope 12 with low cost.

The reader will now appreciate the present invention which provides a rope recovery tool where the rope is attached to an anchor and the anchor cannot be retrieved.

LIST OF COMPONENTS
The drawings include the following integers.

| | |
|---|---|
| a boat | 10 |
| an anchor rope | 12 |
| an anchor chain | 14 |
| an anchor | 16 |
| sea floor | 18 |
| a recovery rope | 20 |
| a recovery tool | 22 |
| a weight | 24 |
| a saddle | 26 |
| a shackle | 30 |
| a blade | 32 |
| a scissor mouth | 322 |
| a bolt | 34 |

-continued

| LIST OF COMPONENTS<br>The drawings include the following integers. | |
|---|---|
| a nut | 36 |
| a hinge | 40 |
| a hasp lock | 42 |

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparat us. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A method of recovering an anchor rope comprising:

providing a rope recovery tool including a body having a weight and a saddle which define a cavity between them, wherein the cavity extends longitudinally from a first end of the body to a second end thereof; wherein a blade is nested within the cavity, wherein the blade is pivotally engaged with the saddle, and wherein a cutting surface is provided on the blade;

attaching a recovery rope to the rope recovery tool;

receiving the anchor rope through the cavity;

feeding the rope recovery tool downwardly from a surface of a body of water and along the anchor rope until the rope recovery tool reaches an end of the anchor rope;

wherein when the rope recovery tool moves down the anchor rope and away from the surface of the body of water, the cutting surface of the blade faces away from the anchor rope and is unable to cut the anchor rope;

wherein, when an anchor on the anchor rope becomes snagged, pulling the recovery rope upwardly and moving the rope recovery tool in a direction away from the anchor and towards the surface of the body of water;

contacting the cutting surface of the blade with the anchor rope; and wherein through application of a pulling force applied by a human operator and through friction, the anchor rope is cut free from the anchor by the blade of the rope recovery tool.

2. The method of claim 1, wherein when the recovery rope is selectively pulled upwardly to move the rope recovery tool back towards the surface of the body of water, the anchor rope travels along a V-shape of the cutting surface from a wider region of the cutting surface to a narrower region thereof and is severed by the cutting surface.

3. The method of claim 1, wherein when the rope recovery tool is pulled upwardly towards the surface of the body of water, the cutting surface of the blade intersects the anchor rope and cuts the same.

4. A rope recovery tool for use on an anchor rope engaged with an anchor, said rope recovery tool comprising:

a body including a weight and a saddle which define a cavity between them, wherein the cavity extends longitudinally from a first end of the body to a second end thereof, and wherein the cavity is adapted to receive the anchor rope therethrough;

a blade nested within the cavity, wherein the blade is pivotally engaged with the saddle;

wherein the blade defines screw holes through which a bolt is screwed in order to fix the blade to the saddle;

a cutting surface provided on the blade;

a recovery rope attached to the rope recovery tool, wherein the recovery rope is adapted to be engaged with the anchor rope; and wherein the rope recovery tool is adapted to be located proximate an end of the anchor rope.

5. The rope recovery tool of claim 4, wherein the bolt screws in sequence through a screw hole on the saddle, through the screw holes of the blade, through another screw hole on the saddle, and then into a nut to ensure that the blade remains in place.

6. The rope recovery tool of claim 4, further comprising a hinge which permanently attaches a first side of the saddle to the weight, wherein the first side extends between the first end and the second end of the body.

7. The rope recovery tool of claim 4, wherein the blade pivots relative to the saddle under effect of gravity.

8. The rope recovery tool of claim 4, wherein the blade has a first end proximate the first end of the body and a second end proximate the second end of the body, and the second end of the blade is pivotally engaged with the saddle.

9. The rope recovery tool of claim 4, wherein the blade has a first end proximate the first end of the body and a second end proximate the second end of the body; wherein the cutting surface is V-shaped with a wider region proximate the second end of the blade and wherein the cutting surface tapers inwardly to a narrower region disposed between the first end and the second end of the blade.

10. The rope recovery tool of claim 4, wherein the saddle has a second side opposed to the first side, and wherein the rope recovery tool further comprises a locking mechanism operable to secure the second side of the saddle to the weight.

11. The rope recovery tool of claim 10, wherein the locking mechanism includes a hasp lock.

12. The rope recovery tool of claim 10, wherein the body is movable between a closed position and an open position.

13. The rope recovery tool of claim 12, wherein when the body is in the closed position, the locking mechanism secures the second side of the saddle to the weight, and when the body is in the open position, the locking mechanism is disengaged and the saddle is pivotable about a hinge and relative to the weight.

* * * * *